US005526792A

United States Patent [19]

Guth et al.

[11] Patent Number: 5,526,792

[45] Date of Patent: Jun. 18, 1996

[54] INTERMITTENT FUEL SUPPLY INJECTION SYSTEM AND METHOD

[75] Inventors: Torsten Guth, Gerswalde; Martin Freitag; Bernhard Baechle, both of Friedrichshafen; Dieter Schoenfeld, Markdorf, all of Germany

[73] Assignee: MTU Motoren- und Turbinen-Union Friedrichshafen GmbH, Germany

[21] Appl. No.: 446,573

[22] Filed: May 19, 1995

[30] Foreign Application Priority Data

May 21, 1994 [DE] Germany ..... 44 17 950.2

[51] Int. Cl.[6] ..... F02M 39/00; F02M 37/04

[52] U.S. Cl. ..... 123/467; 123/496

[58] Field of Search ..... 123/446, 447, 123/506, 467, 496; 239/88, 96

[56] References Cited

U.S. PATENT DOCUMENTS

| | | | |
|---|---|---|---|
| 3,943,901 | 3/1976 | Takahashi et al. | 123/467 |
| 4,633,836 | 1/1987 | Fambel | 123/467 |
| 4,665,881 | 5/1987 | Wade | 123/467 |
| 4,838,232 | 6/1989 | Wich | 123/506 |
| 4,969,600 | 11/1990 | Nicol | 123/506 |

FOREIGN PATENT DOCUMENTS

| | | |
|---|---|---|
| 2441841 | 3/1976 | Germany . |
| 4027493A1 | 3/1991 | Germany . |

OTHER PUBLICATIONS

The Electronically Controlled Dynamic Rail Injection System (DIS), Dr. Ing. M. Ganser, 24 pages (Date unknown).

*Primary Examiner*—Thomas N. Moulis

*Attorney, Agent, or Firm*—Evenson, McKeown, Edwards & Lenahan

[57] ABSTRACT

An injection system provides an intermittent supply of fuel mixture into combustion spaces of an internal-combustion engine. The system includes a valve and a pipe by way of which a control space in the injection valves may alternatively be acted upon by a pressure. The control space is formed by a valve member and a piston. A first pressure spring presses the valve member onto an injection opening, and a second pressure spring presses the piston away from the injection opening.

10 Claims, 3 Drawing Sheets

INTERMITTENT FUEL SUPPLY INJECTION SYSTEM AND METHOD

BACKGROUND AND SUMMARY OF THE INVENTION

The present invention relates to an injection system for intermittent supply of fuel mixtures into combustion spaces of an internal-combustion engine, and to a process for operating such an injection system.

Conventional fuel injection systems generate the required high pressure for the fuel supply into the combustion spaces of internal-combustion engines, such as diesel engines, by way of pumps which are driven directly by the internal-combustion engines. At a low rotational engine speed, the pumping capacity may become insufficient and the fuel distribution may become inaccurate. This leads to power losses and increased pollutant emissions of the internal-combustion engine. These conventional fuel injection systems are also not very variable. In addition, these conventional fuel injection systems are susceptible to inoperability because they have a large number of moving parts.

So-called common rail systems with a central pump for the delivery of the fuel in high-pressure pressure reservoirs and, from there, continuously and without jerking via pipes, to the injection valves uncouple the injection from pressure fluctuations which occur at large. rotational speed differences in the case of conventional pumps driven directly by the engines.

One known common rail injection system ("The Electronically Controlled Dynamic Rail Injection System (DIS)", Ganser-Hydromag) delivers fuel from a fuel reservoir by way of a high-pressure pump into a large-volume pipe system which is connected with injection valves. The injection valves can be actuated by hydraulic pressure, and electromagnetic valves control the opening and closing of the injection valves as a function of operating parameters of the internal-combustion engine. A disadvantage is the high pressure in the injection system, and the high pressure generated by the pump is applied along the entire length of the pipes to the injection openings of the injection valves, even when no injection takes place and a leakage of the fuel can therefore occur, for example, on the connection pieces of the pipes as well as past the closed injection openings into the combustion spaces. Because of safety aspects which must be taken into account during the design phase, the high pressure therefore requires an increased weight and causes problems during the control of the injection system.

DE 24 41 841 A1 shows an injection system for an internal-combustion engine in which a fuel pump and an injection nozzle are integrated in a common housing and in which, by way of the axial displacement of a valve needle. via a control piston and a pressure generator, the fuel is injected from a distributing space into the combustion space of the internal-combustion engine. A readjusting pressure spring is provided for the valve needle. In this known injection system, the function of the control of the valve needle cannot be separated from the pumping operation, and variability is very limited with respect to the control and the pressure level. This known injection system does not solve the existing problem of the high-expenditure design because of high storage pressures in common rail injection systems.

DE 40 27 493 A1 describes an injection nozzle for an internal-combustion engine in which the valve needle is loaded at intervals by two different locking springs in order to achieve a control of the injection pressure over time.

It is an object of the present invention to provide an injection system for the intermittent feeding of fuel mixtures into combustion spaces of an internal-combustion engine and a process for operating this injection system for the intermittent feeding of fuel mixtures which permits a simple control and the providing of standardized parts, for example pumps, which results in low weight and avoids leakage.

This object has been achieved in accordance with the present invention by an injection system for the intermittent feeding of fuel mixtures into combustion spaces of an internal-combustion engine, comprising an injection nozzle and an injection pump integrated in a common housing. An injection valve has a valve member configured to be movable along a longitudinal axis of the injection valve to selectively expose and close an injection opening. A rearward end of the valve member is connectable with a piston configured and arranged to be axially movable in a cylinder bore of the housing. A side of the piston facing the opening, together with the cylinder bore, forms a control space configured to be acted upon by a control pressure. A sleeve-shaped control piston is arranged coaxially to the valve member. One end of the control piston projects into the control space and another end of the control piston projects into a fuel distribution space above the opening. A side of the piston facing away from the opening and the side of the control piston facing the opening each are acted upon by a pressure spring, and a control valve permits the fuel supply from a pressure source of an increased pressure to the fuel distribution space.

Moreover, a method according to the present invention is characterized by connecting the control space with the pressure source for providing the increased pressure so that the valve member exposes the injection opening, moving the piston toward the injection opening, injecting fuel mixture, thereafter connecting the control space with a lower pressure so that the valve member closes the injection opening, and moving the piston away from the injection opening while the pressure is reduced and no injection takes place.

According to the present invention, an injection system for the intermittent feeding of fuel mixtures into combustion spaces of an internal-combustion engine comprises hydraulically actuated injection valves which each contain a valve member and a piston. Fuel mixture is continuously fed to the injection valves at a predetermined pressure. A valve member and a piston form a variable control space which, by way of a switchable valve, which is connected alternatively with a device for providing an increased pressure (p1) or with a pipe with a much lower pressure (p0). A first pressure spring acts upon the valve member and a second pressure spring acts upon the piston, the first pressure spring having a larger spring rate than the second pressure spring.

The amount of the fuel mixture supplied into the combustion space per injection is determined by the switching positions of the valve for the control space. When the control space is connected with the pipe with the pressure (p0), the valve member is pressed by the first pressure spring onto an injection opening of the injection. valve so that no injection will take place. At the same time, the second pressure spring presses the piston away from the injection opening so that the space in front of the injection opening is enlarged, and the pressure in the space in front of the injection opening of the injection valve is rapidly reduced (rapid end of injection; no afterinjection). When the control space is connected with the pipe with the pressure (p1), the valve member is lifted off the injection opening of the injection valve so that the injection will take place. At the same time, pressure (p1) presses the piston toward the injection opening so that the space in front of the injection opening is reduced, and the pressure at which the fuel mixture is transported through the injection opening of the injection valve is rapidly increased.

The injection system according to the present invention can be operated by a clearly lower pressure than a conventional common rail injection system and results in less afterinjection into the combustion space of the internal-combustion engine and in lower leakages at the connection points. Accordingly, the injection system can be equipped with standardized parts, particularly with a standardized pump for generating pressure, and can therefore be manufactured at low cost and have a lower weight than an injection system which must be sized for higher pressures.

By the use according to the present invention of hydraulic oil or engine oil, a medium for the control of the injection system is provided which is particularly suitable for the transmission of p0 and p1 pressures.

The pressure (p1) for the control of the injection system according to the present invention may be generated by a mechanically operated pump, such as a cam plunger pump. A magnetic valve on the pump can limit the pressure (p1) in the injection system. The pressure (p1) for the control of the injection valve can be provided by a central pressure accumulator so that, independently of the rotational speed of the internal-combustion engine, a constant pressure is available for controlling the injection valve.

According to an advantageous aspect of the injection system according to the present invention, fuel mixed with a second suitable liquid, such as water, is delivered in a common pipe in front of the injection opening.

By way of a throttle in a pipe from the valve to the control space and a bypass pipe in parallel to the pipe from the valve to the control space, the pressure in the control space can be modulated. The injection can, therefore, be controlled in a targeted manner so that the fuel consumption and the pollutant emissions of the internal-combustion engine as a whole can be reduced.

According to the present invention, the injection system of the invention can be particularly easily controlled by actuating a valve and, in addition, as required, by actuating a throttle.

BRIEF DESCRIPTION OF THE DRAWINGS

These and other objects, features and advantages of the present invention will become more readily apparent from the following detailed description thereof when taken in conjunction with the accompanying drawings wherein.

DETAILED DESCRIPTION OF THE DRAWINGS

Figure 1:
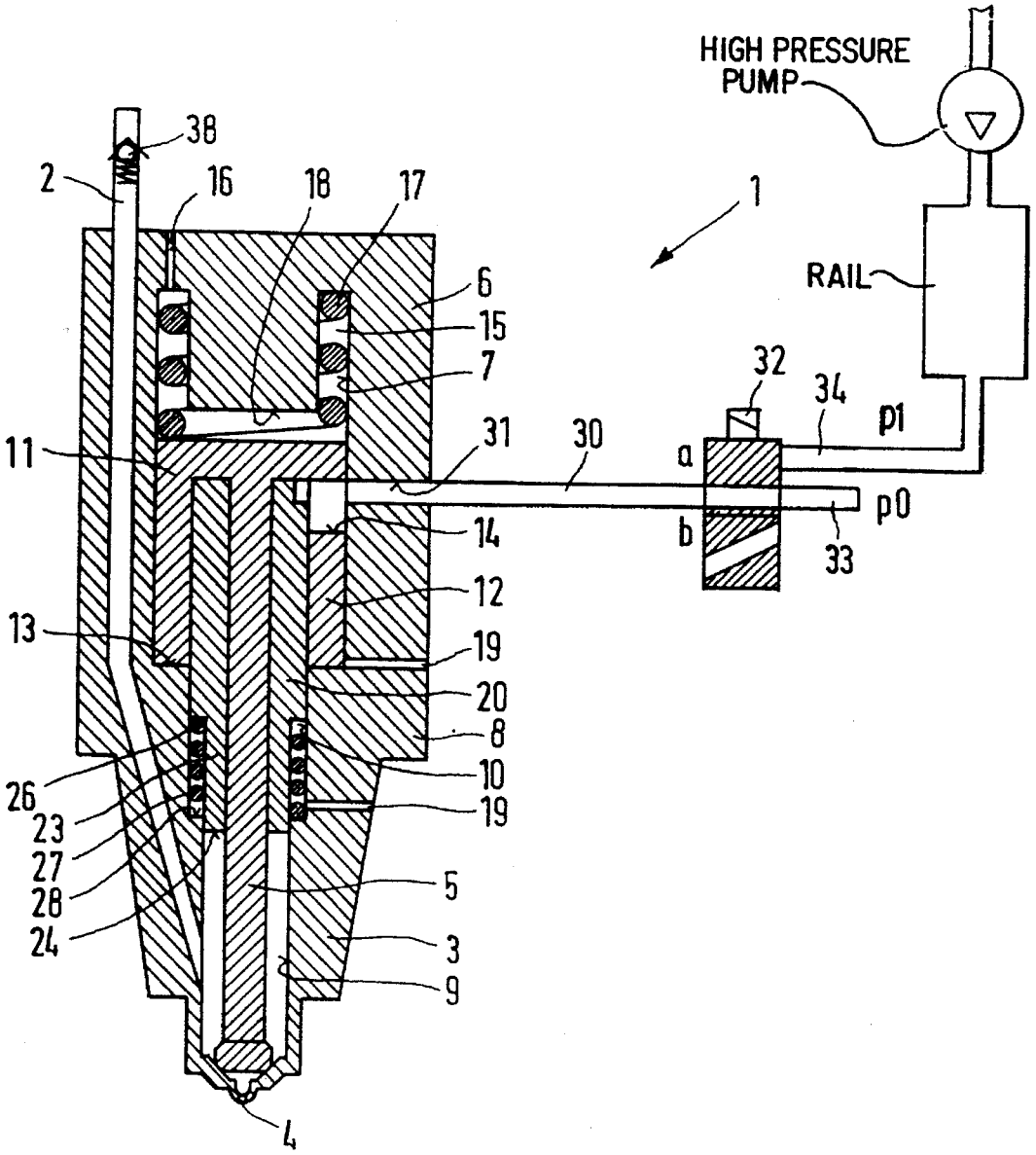
FIG. 1 is a cross-sectional view of an injection system according to the present invention in a first phase.
Figure 2:
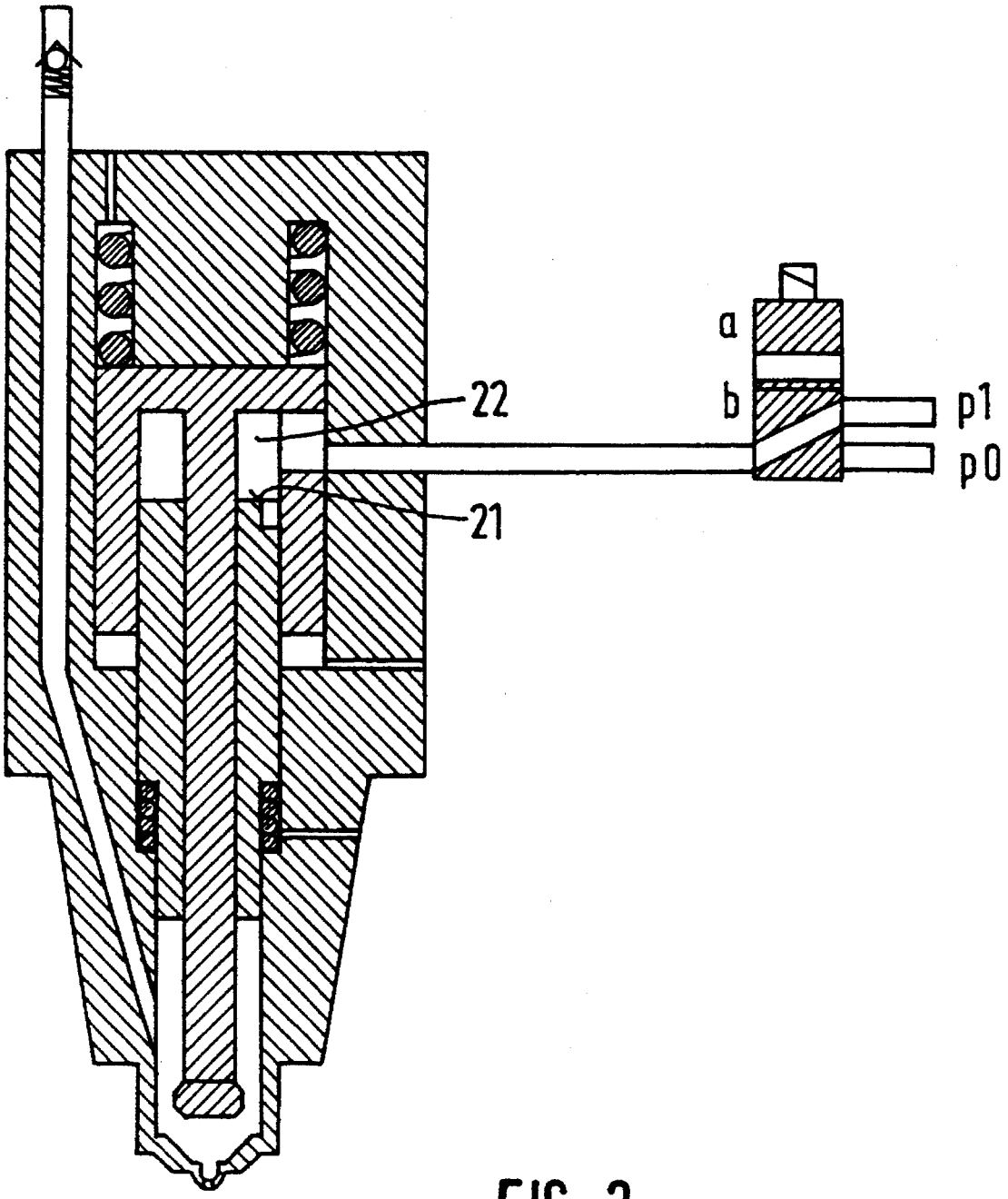
FIG. 2 is a cross-sectional view of the injection system of FIG. 1 in a second phase.

FIGS. 1 and 2 are cross-sectional views of an injection system according to one embodiment of the invention in two phases of an injection operation. No injection takes place in the first phase (phase 1) and the fuel mixture is injected in the second phase (phase 2). An. injection valve designated generally by numeral 1 is one of several injection valves (not shown) of the injection system according to the invention for a generally known multi-cylinder internal-combustion engine, particularly for a diesel engine.

Pressurized fuel mixture is fed from a fuel reservoir of the injection system to the injection valve 1 by way of a pipe 2. The injection valve 1 has a housing 3 comprising at least one injection opening 4 and a rotationally symmetrical valve member 5. In the direction of a longitudinal axis of the housing 3, the valve member 5 is slidably displaced in the housing 3 for opening and closing the injection opening 4.

The housing 3 is preferably constructed in two parts. In a part 6 facing away from the injection opening 4, the housing 3 has a cylindrical recess 7 with a diameter (d1). A part 8 of the housing 3, which also contains the injection opening 4, has a central bore 9 with a diameter (d2) in a lower section adjacent to the injection opening 4 and has a central bore 10 with the diameter (c) in a central section facing the part 6. Diameter (d1) is larger than diameter (d2) or (c), and diameter (c) is larger than diameter (d2).

On its side facing away from the injection opening 4, the valve member 5 has a piston-shaped end piece 11 by. which the valve member 5 is guided in the cylindrical recess 7 of part 6 of the housing 3. In the cross-sectional view of FIGS. 1 and 2, the piston-shaped end piece 11 is open toward the injection opening 4 and has outer legs 12 arranged to rest on a plane step 13 formed by the housing 3 of the injection valve 1. A radially directed bore 14 is provided in the outer leg 12 of the piston-shaped end piece 11. The housing 3 contains leakage fuel and/or vent bores 19.

In the cylindrical recess 7 of part 6, the piston-shaped end piece 11 of the valve member 5, together with the housing 3, forms a space 15 into which a vent pipe 16 leads. A first pressure spring 17, which is coaxial with respect to the valve member 5, is supported on the housing 3 and on the piston-shaped end piece 11, and presses the valve member 5 on the injection opening 4.

The injection valve 1 contains a piston 20 in the form of a hollow piston which is arranged coaxially with respect to the valve member 5. The piston-shaped end piece 11 and the outer legs 12 of the valve member 5, together with face 21 of the piston 20, enclose a control space 22 (as best seen in FIG. 2). The piston 20 has a constant inside diameter and is slidably guided on the valve member 5 in a liquid-tight manner.

The outside diameter of the piston 20 is step-shaped. On a part 23 of a smaller diameter facing the injection openings 4, the piston 20 has a cylindrical face 24 and, on the side facing the piston-shaped end piece 11, has the cylindrical face 21 of a larger diameter. The piston 20 is guided in the central bores 9, 10 in the housing 3 in a closely adjoining manner so that no liquid can pass between the piston 20 and the housing 3. On its outer circumference, the piston 20 has a stop 26 which interacts with a second pressure spring 27 in part 8 of the housing 3. The second pressure spring 27 is supported on a stop 28 at the transition from the central bore 9 to the central bore 10. The second pressure spring 27 has a much smaller spring rate than the first pressure spring 17.

The pipe 30 also leads into a radially directed bore 31 of part 6 of the housing 3 and contains a 3/2-way valve which connects the pipe 30 either with a pipe 34 of a pressure (p1) or with a pipe 33 of a pressure (p0) which is equal to the ambient pressure. Pressure (p1) is much higher than pressure (p0). The pressure medium may be hydraulic or engine oil. The hydraulic pressure (p1) may be generated by a conventional mechanical pump or may be stored in a common pressure accumulator for several injection valves 1 irrespective of the rotational speed of the internal-combustion engine. A magnetic valve (not shown) may be provided for the switching-off of the pressure (p1) generated by the mechanical pump.

Pipe 2 contains a return valve 38 which prevents the discharge of fuel mixture from the central bore 9 in front of the injection opening 4 in the direction of the pipe 2. The fuel mixture consists preferably of fuel and of a second suitable liquid, such as water.

During the operation of the internal-combustion engine, the fuel mixture is continuously present with increased pressure in pipe 2 and in the central bore 9 of the injection valve 1.

In Phase 1, the valve member 5 is pressed by the first pressure spring 17 by way of the piston-shaped end piece 11 onto the injection opening 4 so that no injection takes place from injection valve 1. Bore 14 in the piston-shaped end piece 11 and bore 31 in part 6 of the housing 3 are disposed above one another, and by way of valve 32, the control space 22 is connected with the pipe 33 with pressure (p0). By the pressure of the fuel in the central bore 9 and by the second pressure spring 27, the piston 20 is pressed away from the injection opening 4 against the piston 11 of the valve member 5.

In Phase 2, the bore 14 in the piston-shaped end piece 11 of the valve member 5 is connected with bore 31 in part 6 of the housing 3. Valve 32 is in a position in which the control space 22 is connected by way of the pipes 30, 34 with the increased pressure (p1), and the valve member 5 is. lifted by the pressure onto the piston-shaped end piece 11 against the first pressure spring 17 from the injection opening 4 of the injection valve 1. The piston 11, which forms one piece with the valve member 5, rests against a face 18 of part 6 of the housing 3.

In the control space 22 at pressure (p1), the piston 20 is pressed against the second pressure spring 27 in the direction of the injection opening 4 and reduces the volume in front of the injection opening 4 in the injection valve 1. Hence, the fuel mixture is pressed at an increased pressure from the central bore 9 through the injection opening 4. The switching time of the valve 32 determines the amount of the fuel mixture per injection in the injection valve 1.

At the conclusion of the injection cycle, the valve 32 moves into the position of the first phase (phase 1). The bore 14 in the piston-shaped end piece 11 of the valve member 5 is connected with the bore 31 in part 6 of the housing 3. The valve member 5 is pressed by the first pressure spring 17 by way of the piston-shaped end piece 11 onto the injection opening 4 so that no injection takes place by injection valve 1. The second pressure spring 27 presses the piston 20 away from the injection opening 4 so that the space in front of the injection opening 4 is enlarged and the pressure in the space in front of the injection opening 4 of the injection valve 1 is rapidly reduced.

Figure 3:
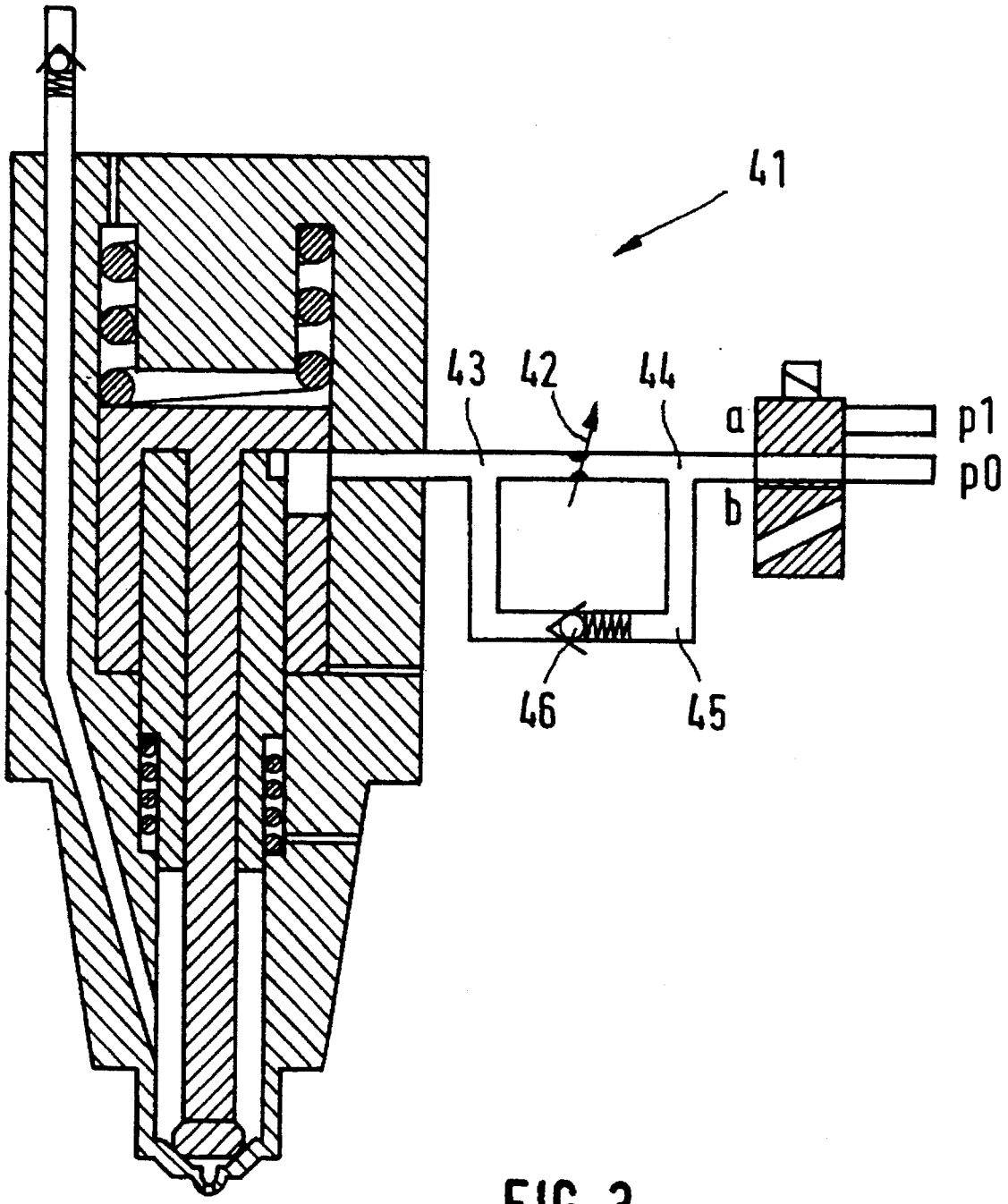
FIG. 3 is a cross-sectional view of an alternative injection system according to the present invention.

FIG. 3 is a cross-sectional view of an alternative injection system according to the present invention whose injection valve 41 corresponds to the injection valve 1 described in FIGS. 1 and 2. Corresponding constructive characteristics of the alternative injection system of FIG. 3 are provided with the same reference numbers as in FIGS. 1 and 2.

Injection valve 41 has a controllable throttle 42 in pipe 30 so that the cross-section of pipe 30 can be varied continuously. Between the throttle 42 and the 3/2-way valve 32 and the throttle 42 and the radially directed bore 31 of the housing 3, connection points 43, 44 of a bypass pipe 45 are provided on the pipe 30. The bypass pipe 45 contains a return valve 46 which prevents the flow through the bypass pipe 45 from the 3/2-way valve 32 to the bore 31 and permits the flow from the bore 31 to the 3/2-way valve 32.

Phases 1 and 2 of the alternative injection system according to FIG. 3 correspond to the respective phases of the injection system of the invention according to FIGS. 1 and 2. When the 3/2-way valve 32 is switched to high pressure (p1), the variable throttle 42 permits, in the case of a slight throttling, a fast pressure rise in the. control chamber 22 of the injection valve 41 and, in the case of a high throttling, a slow pressure rise in the control chamber 22 of the injection valve 41. Corresponding to the pressure buildup in the control chamber 22, the valve member 5 opens the injection opening 4. The throughput through the bores of the injection nozzle which is lower corresponding to the lower pressure ("tired" injection) is important; this creates an injection function. By way of the bypass pipe 45, the pressure in the control space 22 can be reduced rapidly so that the injection opening 4 is closed rapidly by the valve member 5 irrespective of the position of the throttle 42.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. An injection system for an internal-combustion engine, having an injection nozzle and an injection pump integrated in a common housing, comprising an injection valve having a valve member configured to be movable along a longitudinal axis of the injection valve to selectively expose and close an injection opening, a rearward end of the valve member being connectable with a piston configured and arranged to be axially movable in a cylinder bore of the housing, a side of the piston facing the opening, together with the cylinder bore, forming a control space configured to be acted upon by a control pressure, a sleeve-shaped control piston being arranged coaxially to the valve member, one end of the control piston projecting into the control space and another end of the control piston projecting into a fuel distribution space above the opening, a side of the piston facing away from the opening and the side of the control piston facing the opening each being acted upon by a pressure spring, and a control valve for permitting the fuel supply from a pressure source of an increased pressure to the fuel distribution space.

2. The injection system according to claim 1, wherein the control pressure is generated by one of hydraulic oil and engine oil.

3. The injection system according to claim 1, wherein the control valve is an electromagnetic 3/2-way valve.

4. The injection system according to claim 1, wherein the pressure source for providing the increased pressure comprises a mechanically operated pump equipped with a magnetic valve for switching off the pressure.

5. The injection system according to claim 1, wherein the pressure source for providing the increased pressure comprises a central pressure accumulator.

6. The injection system according to claim 1, wherein the fuel mixture includes a liquid.

7. The injection system according to claim 6, wherein the liquid is water.

8. The injection system according to claim 1, wherein the pipe from the control space to the valve is operatively connected with a controllable throttle and a bypass pipe with a return valve.

9. A process for operating an injection system for an internal combustion engine in which an injection nozzle and an injection pump integrated in a common housing and comprising an injection valve having a valve member configured to be movable along a longitudinal axis of the injection valve to selectively expose and close an injection opening, a rearward end of the valve member being connectable with a piston configured and arranged to be axially movable in a cylinder bore of the housing, a side of the piston facing the opening, together with the cylinder bore, forming a control space configured to be acted upon by a control pressure, a sleeve-shaped control piston being arranged coaxially to the valve member, one end of the control piston projecting into the control space and another end of the control piston projecting into a fuel distribution space above the opening, a side of the piston facing away from the opening and the side of the control piston facing the opening each being acted upon by a pressure spring, and a control valve for permitting the fuel supply from a pressure source of an increased pressure to the fuel distribution space, comprising the steps of (a) connecting the control space with the pressure source for providing the increased pressure so that the valve member exposes the injection opening, (b) moving the piston toward the injection opening, injecting fuel mixture, thereafter connecting the control space with a lower pressure so that the valve member closes the injection opening, and (c) moving the piston away from the injection opening while the pressure is reduced and no injection takes place.

10. The process for operating an injection system according to claim 9, comprising the further step of actuating a throttle in the pipe.

* * * * *